US010186180B2

(12) United States Patent
Park et al.

(10) Patent No.: US 10,186,180 B2
(45) Date of Patent: Jan. 22, 2019

(54) DISPLAY DEVICE

(71) Applicant: LG DISPLAY CO., LTD., Seoul (KR)

(72) Inventors: Jaehoon Park, Goyang-si (KR); Jinho Lim, Goyang-si (KR); Cheolhwan Lee, Suwon-si (KR); Kyunghyun Jeon, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 206 days.

(21) Appl. No.: 15/232,544

(22) Filed: Aug. 9, 2016

(65) Prior Publication Data

US 2017/0061839 A1 Mar. 2, 2017

(30) Foreign Application Priority Data

Aug. 26, 2015 (KR) ..... 10-2015-0120226

(51) Int. Cl.

| | |
|---|---|
| ***G09G 3/36*** | (2006.01) |
| ***G09G 3/00*** | (2006.01) |
| ***G09G 3/3266*** | (2016.01) |
| ***G09G 3/20*** | (2006.01) |

(52) U.S. Cl.

CPC ..... *G09G 3/006* (2013.01); *G09G 3/20* (2013.01); *G09G 3/3266* (2013.01); *G09G 3/3677* (2013.01); *G09G 2300/0408* (2013.01); *G09G 2300/0465* (2013.01); *G09G 2310/0205* (2013.01); *G09G 2310/0213* (2013.01); *G09G 2310/0221* (2013.01); *G09G 2310/0267* (2013.01); *G09G 2310/0283* (2013.01)

(58) Field of Classification Search

CPC ..... G09G 3/006; G09G 3/3674; G09G 3/3677
USPC ..... 345/100
See application file for complete search history.

(56) References Cited

U.S. PATENT DOCUMENTS

2013/0265072 A1* 10/2013 Kim ..... G09G 3/006 324/754.01

* cited by examiner

*Primary Examiner* — Roy P Rabindranath
(74) *Attorney, Agent, or Firm* — Dentons US LLP

(57) ABSTRACT

A display device includes a display panel including a first and a second non-display area, a main active area, and a sub active area, wherein the active areas each include a matrix of sub-pixels; a data driver in the first non-display area to provide image data to the matrices of sub-pixels; a main gate driver in the second non-display area to provide a corresponding gate signal to each sub-pixel in the main active area; a sub gate driver in the second non-display area to provide a corresponding gate signal to each sub-pixel in the sub active area; an auto-probe test pad in the non-display area for transmitting a first start signal received from an auto-probe signal generating device to one of the main gate driver and the sub gate driver while testing the display panel; and a signal transmission circuit connecting the main gate driver and the sub gate driver.

19 Claims, 21 Drawing Sheets

--Prior Art--

--Prior Art--

--Prior Art--

--Prior Art--

--Prior Art--

WHEN AP SIGNAL GENERATING
DEVICE SUPPLIES ONLY VST1

--Prior Art--

WHEN AP SIGNAL GENERATING
DEVICE SUPPLIES ONLY VST2

SEQUENTIAL DRIVING OPERATION OF FORWARD DIRECTION

SEQUENTIAL DRIVING OPERATION OF REVERSE DIRECTION

SIMULTANEOUS DRIVING OPERATION OF FORWARD DIRECTION

SIMULTANEOUS DRIVING OPERATION OF REVERSE DIRECTION

DISPLAY DEVICE

CROSS REFERENCE TO RELATED APPLICATIONS

This application claims the benefit of Korean Patent Application No. 10-2015-0120226, filed on Aug. 26, 2015, the entire contents of which is incorporated herein by reference for all purposes as if fully set forth herein.

BACKGROUND

Field of the Disclosure

The present disclosure relates to a display device.

Discussion of the Related Art

Due to development of information technologies, demands for a display device connecting a user to information are increasing. Various types of display devices are used, such as an Organic Light Emitting Display (OLED), a Quantum Dot Display (QDD), a Liquid Crystal Display (LCD), and a Plasma Display Panel (PDP).

Some of the various display devices, for example, the LCD or the OLED, include a display panel which has a plurality of sub-pixels arranged in a matrix form, a driver which outputs a driving signal for driving the display panel, and a power supply which generates power to be supplied to the display panel or the driver.

For the LCD or the OLED, a display panel is manufactured and then a test process is conducted to test the display panel. In the test process, an auto-probe test is used to test electrical features of the display panel (e.g., a line shortage test and a lighting test).

The auto-probe test is conducted in a manner that a probe needle is put in contact with an auto-probe test pad (hereinafter, referred to as an "AP pad") formed on a substrate of the display panel and then an electrical signal is applied.

As a result, a structure in which a gate driver is formed in a Gate In Panel (GIP) method on a substrate of the display panel such that a main gate driver and a sub gate driver are able to be driven individually. If the gate driver has the aforementioned structure, an AP pad and a start signal line (hereinafter, referred to as a "AP line") have to be formed to apply an electrical signal to the main gate driver and the sub gate driver, respectively.

However, if the AP pad and the AP line are formed on a substrate of the display panel outside the display area, a bezel area may increase to cover these structures.

SUMMARY OF THE INVENTION

Accordingly, the present invention is directed to a display device and a method of driving the same that substantially obviate one or more problems due to limitations and disadvantages of the related art.

An advantage of the present invention is to provide a display device and a method of driving the same such that an auto-probe test pad and gate drivers are in a non-display area of a display panel in a configuration to minimize the non-display area. Thereby saving space and minimizing the bezel area of the display device.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

One exemplary embodiment of the invention includes a display device, including a display panel including a first non-display area, a second non-display area, a main active area, and a sub active area, wherein the main active area and the sub active area each includes a matrix of sub-pixels; a data driver in the first non-display area to provide image data to the matrices of sub-pixels; a main gate driver in the second non-display area to provide a corresponding gate signal to each sub-pixel in the main active area; a sub gate driver in the second non-display area to provide a corresponding gate signal to each sub-pixel in the sub active area; an auto-probe test pad in the non-display area for transmitting a first start signal received from an auto-probe signal generating device to one of the main gate driver and the sub gate driver while testing the display panel; and a signal transmission circuit to transmit signals between the main gate driver and the sub gate driver.

A second exemplary embodiment of the invention includes a display device, including a lower substrate, a display area, a data driver, a gate driver, and a signal transmission circuit. The display area includes a main display area and a sub display area, each of which consists of sub-pixels disposed on the lower substrate. A data driver transmits a data signal to the main display area and the sub display area. The gate driver includes a main gate driver transmitting a gate signal to the main display area, and a sub gate driver transmitting a gate signal to the sub display area. The signal transmission circuit transmits signals, which are output from input and output terminals of the main gate driver and the sub gate driver, in a first direction or in a second direction.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Reference will now be made in detail embodiments of the invention by examples of which are illustrated in the accompanying drawings. Hereinafter, detailed embodiments of the present disclosure are described in conjunction with the accompanying drawings.

A display device according to the present disclosure can be included in a TV, a set-top box, a navigation system, an image player, a Blu-ray player, a personal computer (PC), a home theater, a mobile phone, or the like. A display panel of the display device may be selected from technologies including an Organic Light Emitting Display (OLED), a Quantum Dot Display (QDD), a Liquid Crystal Display (LCD), or a Plasma Display Panel (PDP), but aspects of the present disclosure are not limited thereto.

For the LCD or the OLED, a display panel is manufactured and a test process is conducted to test the display panel. In the test process, an auto-probe test is used to test electrical features of the display panel (e.g., a line shortage test and a lighting test).

The auto-probe test is conducted in a manner that a probe needle is put in contact with an auto-probe test pad (hereinafter, referred to as an "AP pad") formed on a lower substrate of the display panel and then an electrical signal is applied.

Figure 1:
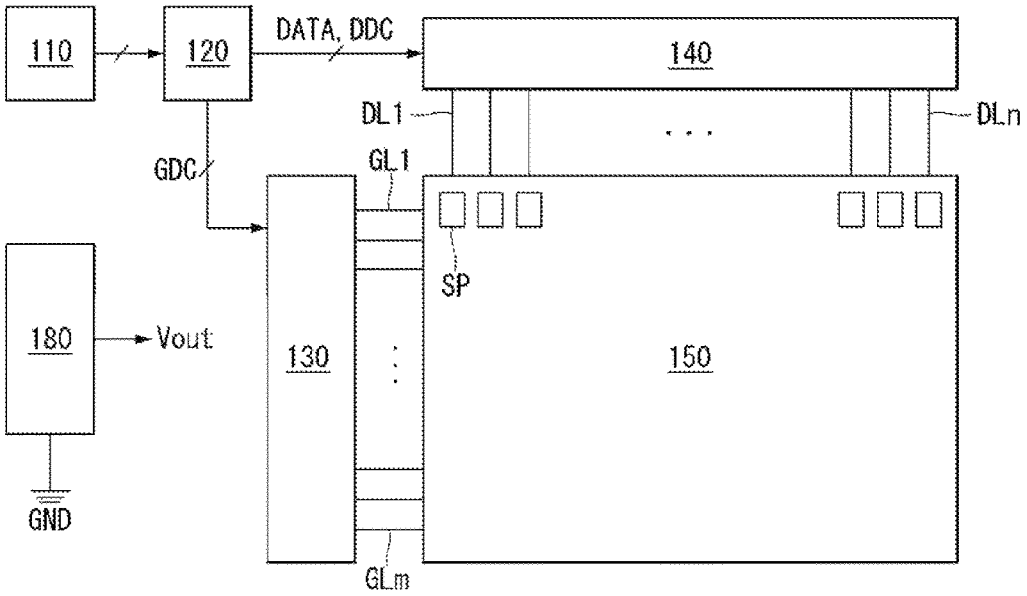
FIG. 1 is a block diagram illustrating a display device.
Figure 2:
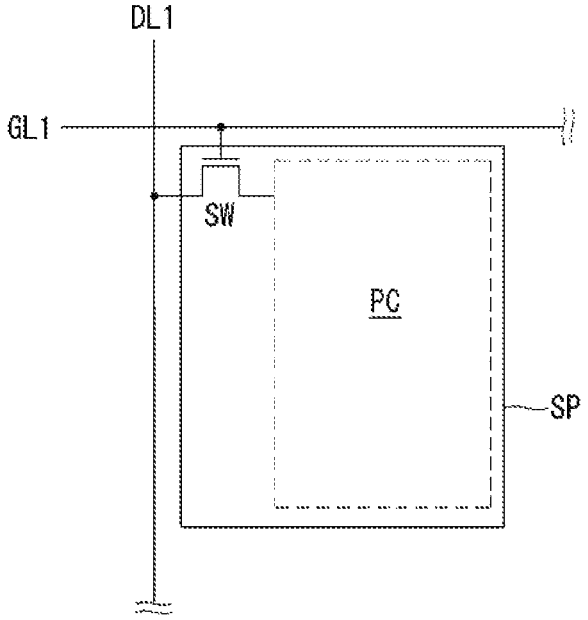
FIG. 2 is a diagram illustrating a sub-pixel shown in FIG. 1.

FIG. 1 is a block diagram illustrating a display device, and FIG. 2 is a diagram schematically illustrating a sub-pixel shown in FIG. 1.

As shown in FIG. 1, a display device includes an image supplier 110, a timing controller 120, a gate driver 130, a data driver 140, a display panel 150, and a power supply 180.

The image supplier 110 performs image processing on a data signal, and outputs the data signal together with a vertical sync signal, a horizontal sync signal, a data enable signal, and a clock signal. Through a low voltage differential signaling (LVDS) interface or a transition minimized differential signaling (TMDS) interface, the image supplier 110 supplies the vertical sync signal, the horizontal signal, the data enable signal, the clock signal, and the data signal to the timing controller 120.

The timing controller 120 receives a data signal DATA from the image supplier 110, and outputs a gate timing control signal GDC for controlling an operation timing of the gate driver 130, and a data timing control signal DDC for controlling an operation timing of the data driver 140.

Through a communication interface, the timing controller 120 also outputs the data signal DATA together with the gate timing control signal GDC and the data timing control signal DDC.

In response to the gate timing control signal GDC received from the timing controller 120, the gate driver 130 outputs a gate signal (or a scan signal) while shifting a level of a gate voltage. The gate driver 130 includes a level shifter and a shift register.

The gate driver 130 supplies the gate signal to a matrix of sub-pixels SP included in the display panel 150 through gate lines GL1 to GLm. The gate driver 130 may be formed separately as an integrated circuit (IC), or may be integrally formed on the display panel 150 in a Gate In Panel (GIP) method.

In response to the data timing control signal DDC received from the timing controller 120, the data driver 140 samples and latches the data signal DATA, converts the data signal DATA into an analog signal in response to a gamma reference voltage, and outputs the analog signal. Through data lines DL1 to DLn, the data driver 140 supplies the data signal DATA to the matrix of sub-pixels SP included in the display panel 150. As mentioned, the data driver 140 may be formed as an integrated circuit (IC).

The power supply 180 generates and outputs voltages Vout, Vgh, Vgl and GND based on an externally supplied input voltage. A high potential voltage Vout, a gate high voltage Vgh, a gate low voltage Vgl and a low potential voltage GND, which are output from the power supply 180, are used in various components included in the display device. For example, the high potential voltage Vout and the low potential voltage GND may be supplied to the display panel 150, and the gate high voltage Vgh and the gate low voltage Vgl may be supplied to the gate driver 130.

In response to the gate signal received from the gate driver 130 and the data signal received from the data driver 140, the display panel 150 displays an image. The display panel 150 includes a lower substrate and an upper substrate. Sub-pixels SP are formed between the lower substrate and the upper substrate.

As shown in FIG. 2, one sub-pixel includes a switching thin film transistor (TFT) SW connected between a gate line GL1 and a data line DL1 (or formed at a crossing of a gate line GL1 and a data line DL1), and a pixel circuit PC which operates in response to a data signal DATA transmitted through the switching TFT SW. Sub-pixels may be configured as liquid-crystal cells of a Liquid Crystal Display (LCD) panel, or may be configured as organic light emitting devices of an organic light emitting display panel.

In a case where the display panel 150 is an LCD panel, the display panel 150 may operate in a Twisted Nematic (TN) mode, a Vertical Alignment (VA) mode, an In Plane Switching (IPS) mode, a Fringe Field Switching (FFS) mode, or an Electrically Controlled Birefringence (ECB) mode. In a case where the display panel is an OLED panel, the display panel 150 may be a top-emission type, a bottom-emission type, or a dual-emission type.

The above-described display device may display an image as the sub-pixels of the display panel 150 emits or transmits light based on voltages Vout and GND output from the power supply 180, a gate signal output from the gate driver 130, and a data signal DATA output from the data driver 140.

[Experimental Example of the Related Art]

Figure 3:
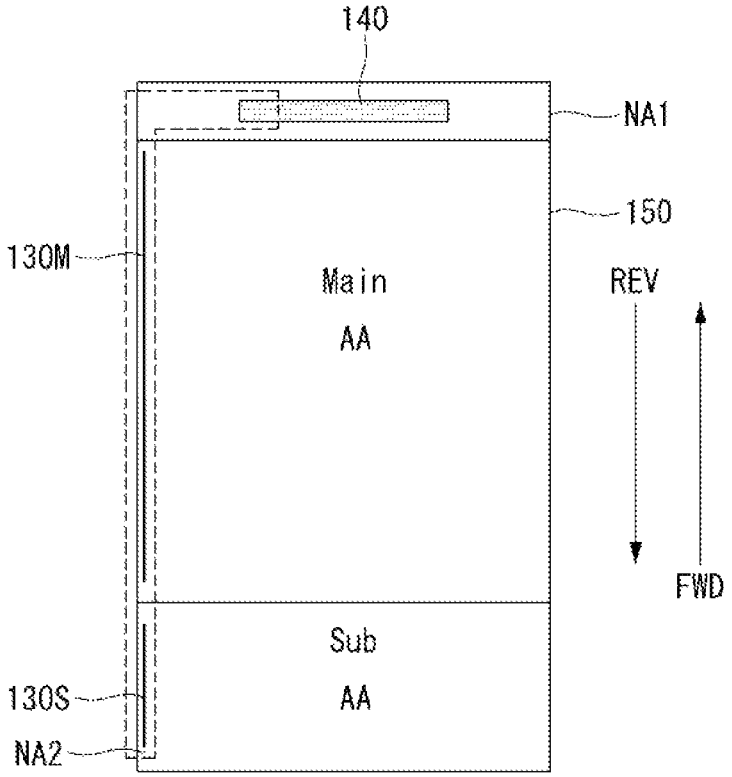
FIG. 3 is a diagram illustrating a display panel according to an experimental example of the related art.
Figure 4:
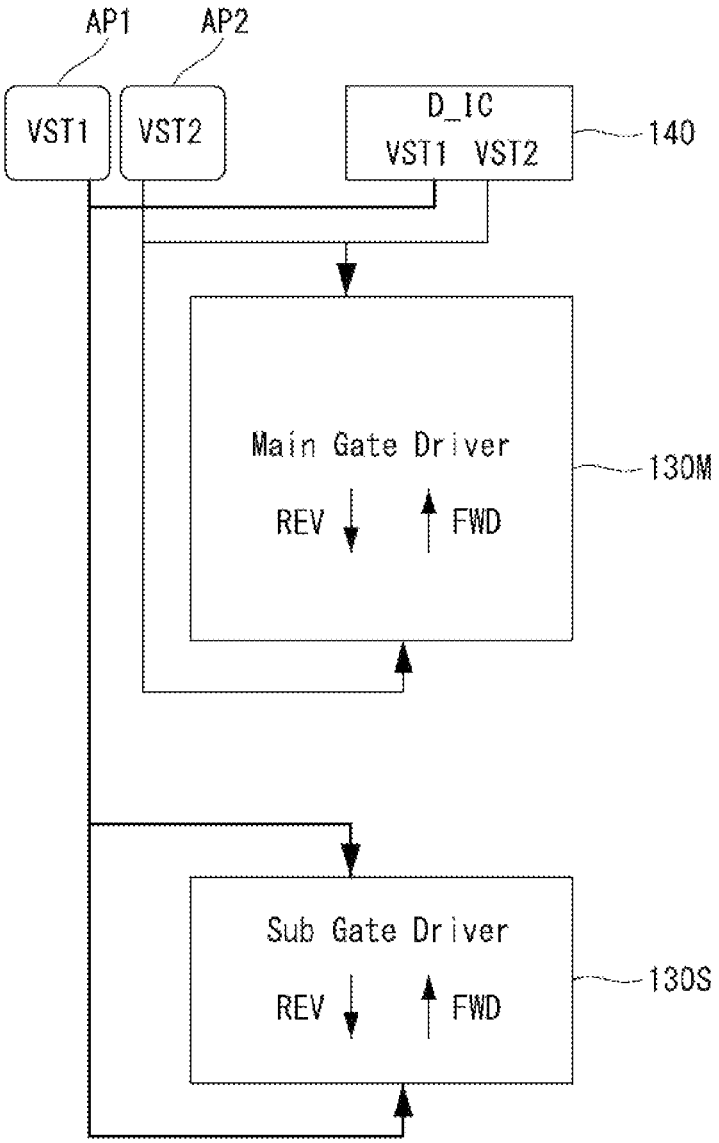
FIG. 4 is a diagram illustrating part of a display panel according to an experimental example of the related art.
Figure 5A:
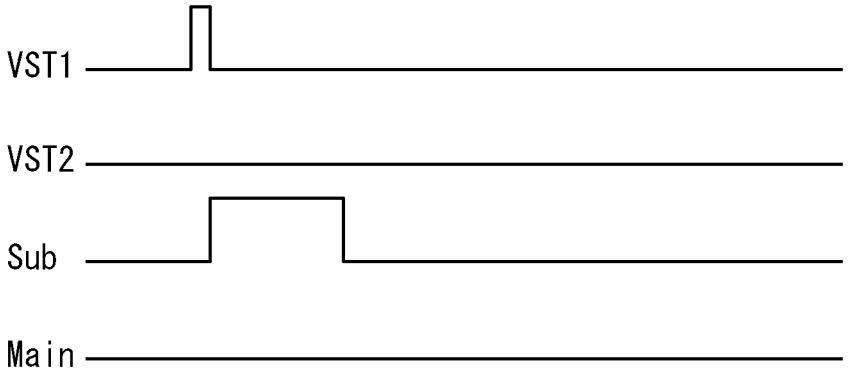
FIGS. 5A and 5B are waveform diagrams illustrating an auto-probe start signal of a display panel according to an experimental example of the related art.
Figure 5B:
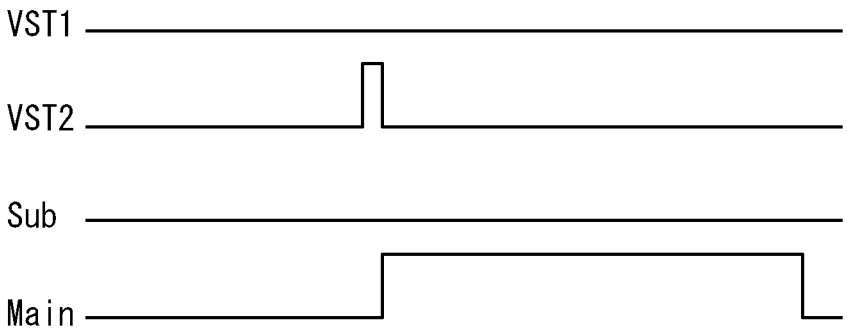

FIG. 3 is a diagram schematically illustrating a display panel according to an experimental example of the related art; FIG. 4 is a block diagram illustrating part of a display panel according to an experimental example of the related art; and FIGS. 5A and 5B are waveform diagrams illustrating auto-probe start signals of a display panel according to an experimental example of the related art.

As shown in FIGS. 3 to 5B, the data driver 140 is formed in a first non-display area NA1 of the display panel 150, which is located on an upper portion of the display panel 150. Gate drivers 130M and 130S are formed in a second non-display area NA2 of the display panel 150, which are located on a side portion of the display panel 150. The matrix of sub-pixels are formed in an active area AA.

In the gate drivers 130M and 130S, a main gate driver 130M and a sub gate driver 130S may be formed on the lower substrate of the display panel 150 in a GIP method such that the main gate driver 130M and the sub gate driver 130S are able to operate separately.

The main gate driver 130M provides a gate signal to a main display active area Main AA of the display panel 150, and the sub gate driver 130S provides a gate signal to a sub-display active area Sub AA of the display panel 150.

The gate drivers 130M and 130S have a structure as described above. Each active area of the display panel 150 is able to be driven individually as a gate signal is supplied in a forward direction FWD or in a reverse direction REV. In the drawings, for convenience of explanation, a direction from bottom to top on the display panel 150 is defined as a forward direction FWD, and a direction from top to bottom on the display panel 150 is defined as a reverse direction REV. However, aspects of the present disclosure are not limited thereto.

Meanwhile, in a case where the gate drivers 130M and 130S have a structure as described above, an auto-probe test may be conducted only when AP pads AP1 and AP2 supplying electrical signals are formed in the main gate driver 130M and the sub gate driver 130S, respectively. In the experimental example, first and second AP pads AP1 and AP2 are formed in a pad area in a non-display area for use while performing the auto-probe test. As illustrated in FIG. 4, the first AP pad AP1 is a pad which transmits, through a first start signal line, a first start signal VST1 for driving the sub gate driver 130*s*. The second AP pad AP2 is a pad which transmits, through a second start signal line, a second start signal VST2 for driving the main gate driver 130M. Start signals are used to drive the main gate driver 130M and the sub gate driver 130S.

As illustrated in FIGS. 5A and 5B, the first and second start signals VST1 and VST2 transmitted through the first and second AP pads AP1 and AP2 are transmitted to the gate drivers 130M and 130S. The first and second start signals VST1 and VST2 may be transmitted through the first and second AP pads AP1 and AP2 only when the auto-probe test is in process, and may be transmitted through the data driver 140 after the auto-probe test is done.

The above experimental example is a case where two AP pads AP1 and AP2 are used. Accordingly, as shown in FIG. 5A, if only the first start signal VST1 is transmitted from an AP signal generating device (not shown), the sub gate driver 130S alone may operate. Alternatively, as shown in FIG. 5B, if only the second start signal VST2 is transmitted from the AP signal generating device, the gate driver 130M alone may operate.

FIG. 4 is an example in which a start signal is configured to separately drive the main gate driver 130M and the sub gate driver 130S. Thus, it is possible to change a driving method of the gate drivers 130M and 130S to a separate driving method, an individual driving method, a combined driving method depending on a changed order of the start signals VST1 and VST2, or characteristics thereof.

However, the main gate driver 130M and the sub gate driver 130S are separate from each other, so both of the two start signals need to be applied in order to drive both of the main gate driver 130M and the sub gate driver 130S and perform the auto-probe test.

Under this circumstance, to perform the auto-probe test described above, the two AP pads AP1 and AP2 have to be formed in the first non-display area NA1 on the display panel 150. In this case, one more pad has to be formed in the bezel area of the display panel, so that it may add a limitation to design of the display panel and the bezel area may increase in size.

In addition, AP pads and an output from the AP signal generating device are added in the experiment example, so it is difficult to use (or utilize) an existing test device because it cannot solve the problems regarding generation of a start signal and timing control. Hereinafter, drawbacks of the experimental example will be explained, and another experimental example will be described as a way of solving the drawbacks.

[Embodiment 1]

Figure 6:
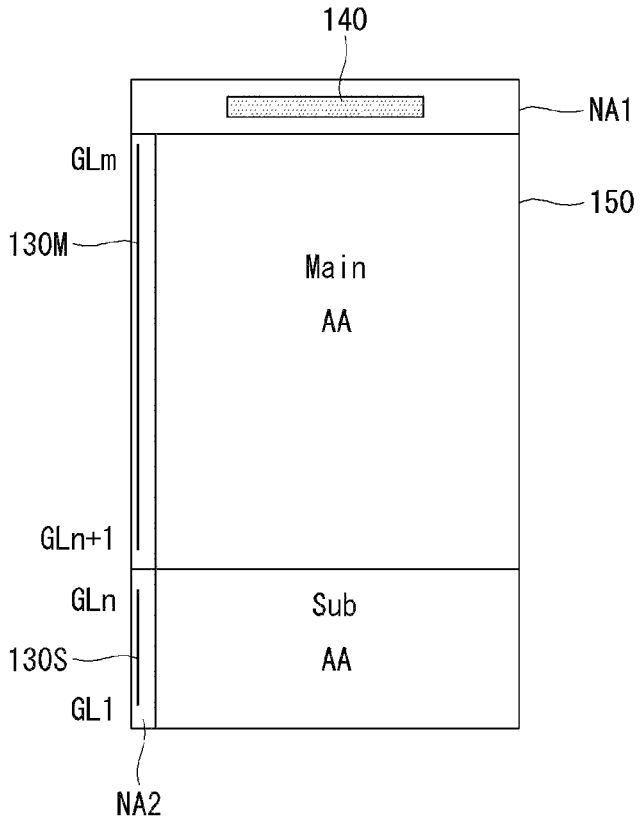
FIG. 6 is a schematic view illustrating a display panel according to the embodiments of the present disclosure.
Figure 9:
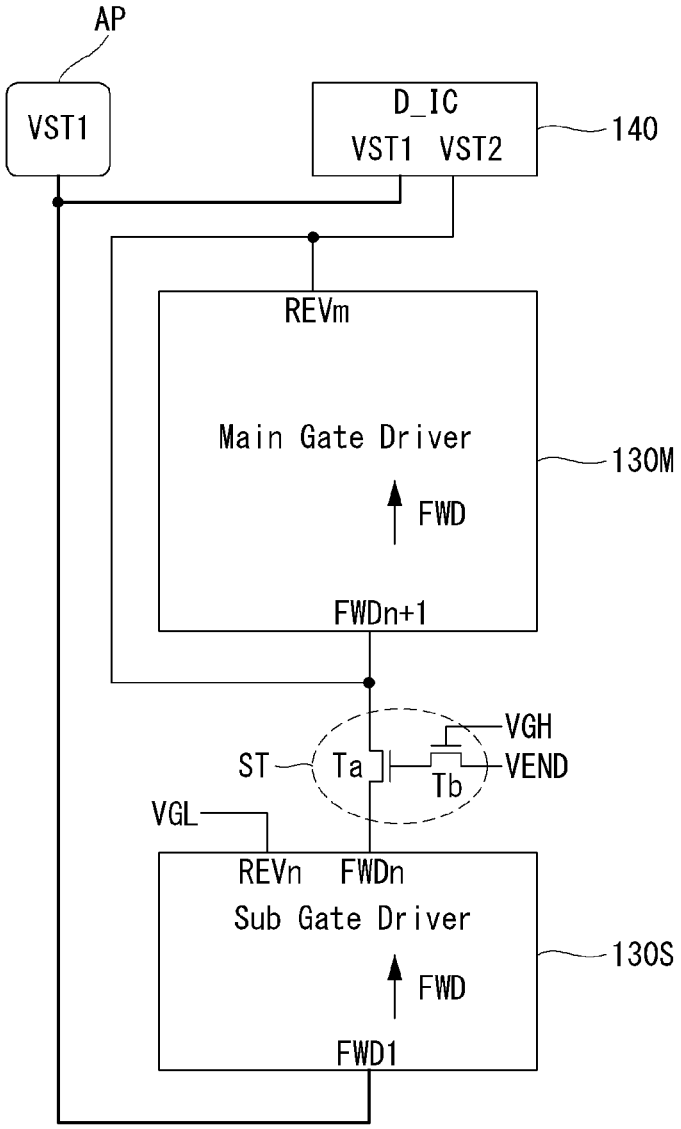
FIG. 9 is a diagram illustrating part of a display panel according to the first embodiment of the present disclosure.
Figure 10:
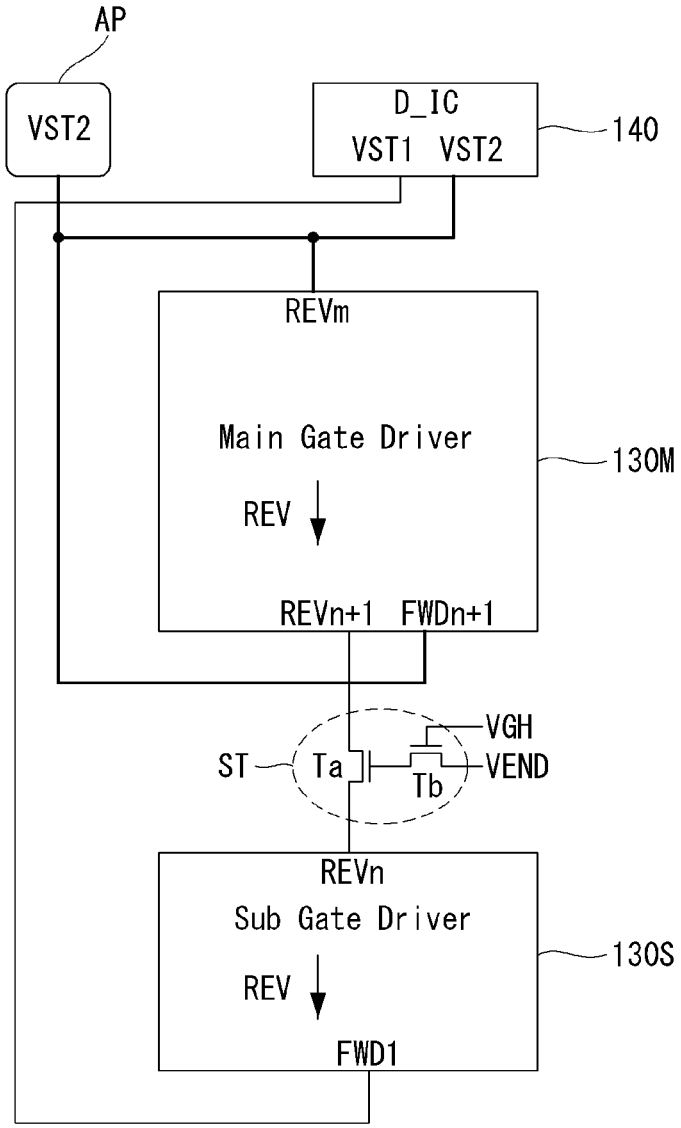
FIG. 10 is a diagram illustrating part of a display panel according to an modified example of the first embodiment of the present disclosure.
Figure 11:
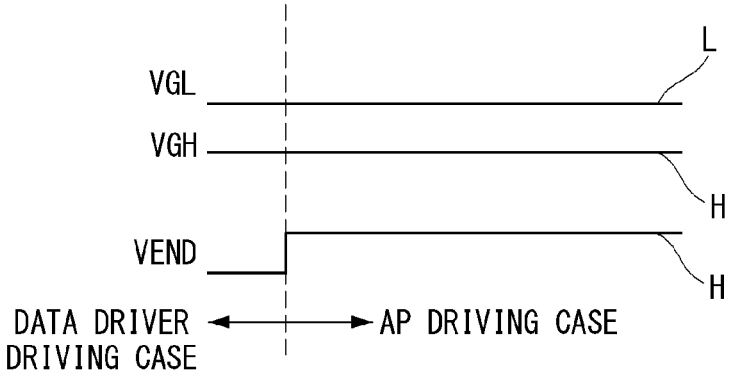
FIG. 11 is a waveform diagram illustrating a signal applied to a test transistor according to driving conditions.
Figure 12:
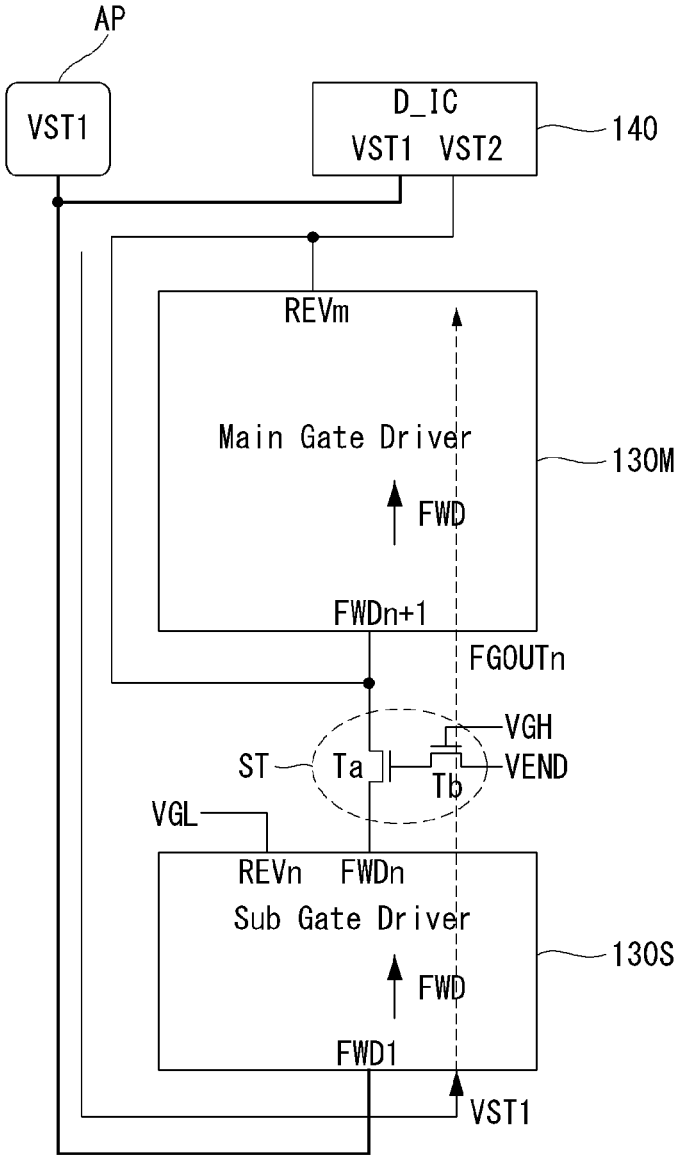
FIGS. 12 and 13 are diagrams illustrating a flow of a start signal applied to a display panel according to the first embodiment of the present disclosure or a modified example thereof.
Figure 13:
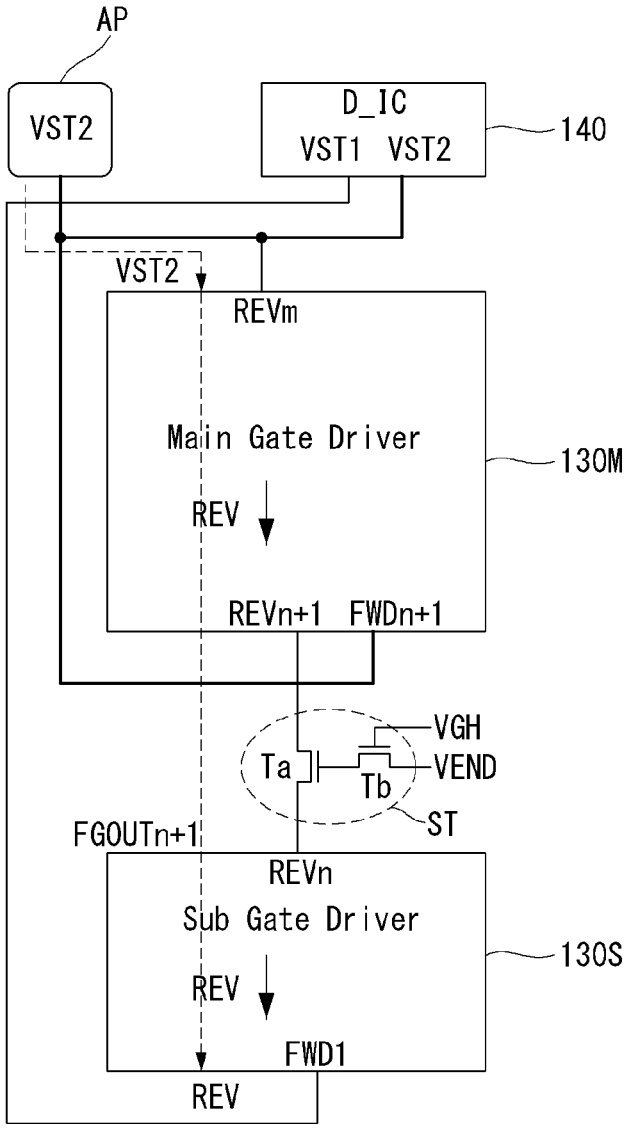

FIG. 6 is a schematic view illustrating a display panel according to the present disclosure; FIGS. 7A, 7B, 8A, and 8B are diagrams illustrating a waveform of an auto-probe start signal on a display panel according to the the present disclosure; FIG. 9 is a block diagram illustrating part of a display panel according to the first embodiment of the present disclosure; FIG. 10 is a block diagram illustrating another part of a display panel according to another aspect of the first embodiment of the present disclosure; FIG. 11 is a waveform diagram illustrating a signal applied to a signal transmission circuit ST according to driving conditions; and FIGS. 12 and 13 are block diagrams illustrating a flow of a start signal applied to a display panel according to the first embodiment of the present disclosure.

As illustrated in FIG. 6 , a data driver 140 is formed in a first non-display area NA1 which is in an upper portion of a display panel 150. Gate drivers 130M and 130S are formed in a second non-display area NA2 which are on a side portion of the display panel.

The gate drivers 130M and 130S are formed, in a Gate In Panel (GIP) method, on a lower substrate of the display panel 150 such that a main gate driver 130M and a sub gate driver 130S are able to be driven individually.

The main gate driver 130M provides a gate signal to a main active area Main AA of the display panel 150, and the sub gate driver 130S provides a gate signal to a sub display active area Sub AA of the display panel 150. The sub gate driver 130S provides a gate signal to each of a first gate line GL1 to the $N^{th}$ gate line GLn which are connected to the sub display active area Sub AA. The main gate driver 130M provides a gate signal to each of the $N+1^{th}$ gate line GLN+1 to the $M^{th}$ gate line GLm which are connected to the main display area Main AA.

As the gate drivers 130M and 130S have the aforementioned structure, the display panel 150 is provided a gate signal in a forward direction FWD or in a reverse direction REV so that each active area may be driven individually (independently). In the drawings, for convenience of explanation, a direction from bottom to top on the display panel 150 is defined as a forward direction FWD, and a direction from top to bottom on the display panel 150 is defined as a reverse direction REV. However, aspects of the present disclosure are not limited thereto.

In the second and third embodiments of the present disclosure, which are described in detail below, along with the first embodiment, a main gate driver 130M and a sub gate driver 130S have a signal transmission circuit connected therebetween to sequentially or simultaneously drive the main gate driver 130M and the sub gate driver 130S in the forward direction or may be driven sequentially or simultaneously in the reverse direction, with relative timing as shown in FIGS. 7 and 8.

Because the signal transmission circuit ST is connected between the main gate driver 130M and the sub gate driver 130S, only a single AP pad is used. A start signal transmitted through the single AP pad is transferred to the gate drivers 130M and 130S. The start signal may be transmitted through the single AP pad during the auto-probe test, and may be transmitted through a data driver after the test. The start signal is used as a signal necessary to drive the main gate driver 130M and the sub gate driver 130S. Meanwhile, FIGS. 7A, 7B, 8A, and 8B illustrate an example in which only a first start signal VST1 is transmitted because a single AP pad is used. However, a second start signal VST2 may be used instead of the first start signal VST1.

Figure 7A:
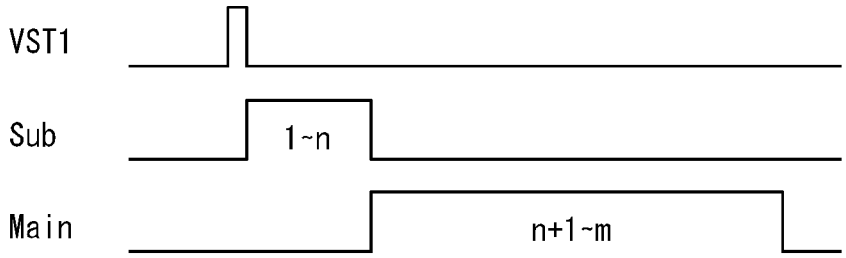
FIGS. 7A, 7B, 8A, and 8B are diagrams illustrating a waveform of an auto-probe start signal on a display panel according to the embodiments of the present disclosure.
Figure 7B:
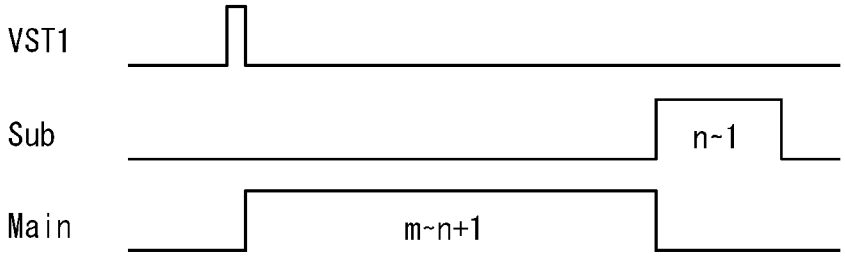

As shown in FIG. 7A, in a case where the main gate driver 130M and the sub gate driver 130S are driven sequentially in the forward direction FWD, operations (the N+1$^{th}$ gate line n+1 to the M$^{th}$ gate line m) of the main display active area Main AA are performed after operations (the first gate line 1 to the N$^{th}$ gate line n) of the sub-display active area Sub AA of the display panel 150 are completed. As shown in FIG. 7B, in a case where the main gate driver 130M and the sub gate driver 130S are driven sequentially in the reverse direction REV, operations (the first gate line 1 to the N$^{th}$ gate line n) of the sub-display active area Sub AA of the display panel 150 are performed after operations (the N+1$^{th}$ gate line n+1 to the M$^{th}$ gate line m) in the main display active area Main AA are completed.

Figure 8A:
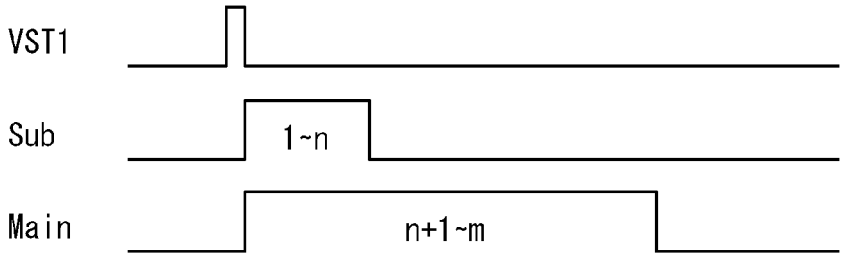
Figure 8B:
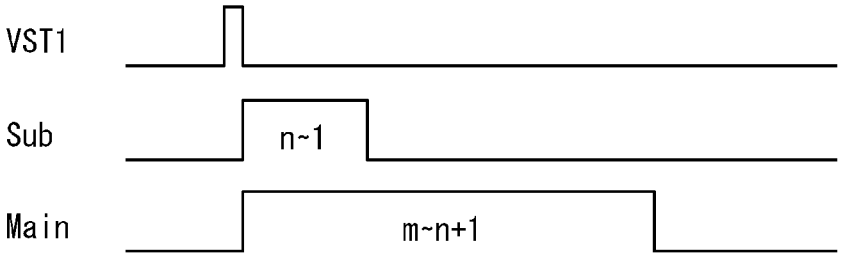

As shown in FIG. 8A, in a case where the main gate driver 130M and the sub gate driver 130S are driven simultaneously in the forward direction FWD, operations (the first gate line 1 to the N+1$^{th}$ gate line n+1) of the main display active area Main AA and the sub-display active area Sub AA of the display panel 150 are performed simultaneously. As shown in FIG. 8B, in a case where the main gate driver 130M and the sub gate driver 130S are driven simultaneously in the reverse direction REV, operations (the N$^{th}$ gate line n to the M$^{th}$ gate line m) of the main display active area Main AA and the sub-display active area Sub AA of the display panel 150 are performed simultaneously.

Hereinafter, is an example in which a signal transmission circuit is connected between the main gate driver 130M and the sub gate driver 130S. The signal transmission circuit may be located between the AP pad and the main gate driver 130M, between the main gate driver 130M and the sub gate driver 130S, on an outer side of the main gate driver 130M, on an outer side of the sub gate driver 130S, or any other suitable position.

In the first embodiment shown in FIGS. 9, 11, and 12, the main gate driver 130M and the sub gate driver 130S operate based on a first start signal VST1 which is transmitted along a first signal line through an AP pad AP.

As illustrated in FIG. 9, a signal transmission circuit ST is connected between the main gate driver 130M and the sub gate driver 130S. The signal transmission circuit ST transfers a signal output from the N$^{th}$ forward direction terminal FWDn of the sub gate driver 130S to the N+1$^{th}$ forward direction terminal FWDn+1 of the main gate driver 130M.

The signal transmission circuit ST includes a first transistor Ta and a second transistor Tb. In this and the following examples, the first transistor Ta and the second transistor Tb, and all other signal transmission transistors, are N-type transistors. However, the signal transistors may be P-type transistors. The first transistor Ta includes a first electrode connected to the N$^{th}$ forward direction terminal FWDn of the sub gate driver 130S, and a second electrode connected to the N+1$^{th}$ forward direction terminal FWDn+1 of the main gate driver 130M. The second transistor Tb includes a gate electrode connected to a first signal line VGH, a first electrode connected to a second signal line VEND, and a second electrode connected to a gate electrode of the first transistor Ta. A first signal transmitted along the first signal line VGH is generated and controlled by the power supply 180, shown in FIG. 1. A second signal transmitted along the second signal line VEND may use the signal from the AP pad, but aspects of the present disclosure are not limited thereto.

Once the first signal transmitted along the first signal line VGH is changed from logic low level L to logic high level H, the second transistor Tb is turned on. Once the second signal VEND transmitted along the second signal line VEND through the first electrode of the second transistor Tb is changed from logic low level L to logic H, the first transistor Ta is turned on.

Once the first transistor Ta is turned on, the signal transmission circuit ST is activated. Once the signal transmission circuit ST is activated, a signal output from the Nth forward direction terminal FWDn of the sub gate driver 130S is transferred to the N+1$^{th}$ forward direction terminal FWDn+1 of the main gate driver 130M.

The first signal transmitted along the first signal line VGH may use a gate high voltage supplied to the gate drivers 130M and 130S, but aspects of the present disclosure are not limited thereto. In addition, the second signal transmitted along the second signal line VEND may use a gate high voltage supplied to the gate driver 130M and 130S, but aspects of the present disclosure are not limited thereto.

Further, as illustrated in FIG. 11, in a case when the data driver provides the first and/or second signals rather than the case when the auto probe AP generates these signals, the second signal is changed from logic high level H to logic low level L. In particular, the second signal transmitted along the second signal line VEND has to be changed from logic high level H to logic low level L, but the first signal transmitted along the first signal line VGH is able to remain at logic high level H.

As shown in FIG. 9, the N$^{th}$ reverse direction terminal REVn of the sub gate driver 130S is connected to a third signal line VGL. The third signal line VGL supplies a gate-low voltage at logic low level L. The gate low voltage is output from a power supply or a level shifter (not shown). Once a gate low voltage at logic low level L is supplied, the sub gate driver 130S stops being driven in the reverse direction REV based on the design as to which direction the data is driven.

The N+1$^{th}$ forward direction terminal FWDn+1 and the M$^{th}$ reverse direction terminal REVm (the first reverse direction terminal) of the main gate driver 130M are connected to the second electrode of the first transistor Ta.

Accordingly, a signal output from the Nth forward direction terminal FWDn of the sub gate driver 130S may be transferred to the N+1$^{th}$ forward direction terminal FWDn+1 and the M$^{th}$ reverse direction terminal REVm of the main gate driver 130M. The signal output from one of the sub gate driver 130S or the main gate driver 130M devices is a trigger for controlling the other gate driver device.

Referring to FIG. 12, the main gate driver 130M performs a driving operation of the forward direction FWD based on a signal (FGOUTn) output from the N$^{th}$ forward direction terminal FWDn of the sub gate driver 1305. The M$^{th}$ reverse direction terminal REVm of the main gate driver 130M may receive a signal (FGOUTn in FIG. 12) which is output from the N$^{th}$ forward direction terminal FWDn of the sub gate driver 130S.

In the above-described first embodiment of the present disclosure, a start signal VST1 is transferred from an AP pad AP, and, once the signal transmission circuit ST is activated, the sub gate driver 130S and the main gate driver 130M may be driven sequentially in the forward direction FWD.

In another aspect of the first embodiment shown in FIGS. 10, 11, and 13, the main gate driver 130M and the sub gate driver 130S operate based on a second start signal VST2 received through the second start signal line from an AP pad AP.

In this aspect, the signal transmission circuit ST transmits a signal, which is output from the N+1$^{th}$ reverse direction terminal REVn+1 of the main gate driver 130M, to the N$^{th}$ reverse direction terminal REVn of the sub gate driver 130S.

The first transistor Ta includes a first electrode connected to the N$^{th}$ reverse direction terminal REVn of the sub gate driver 130S, and a second electrode connected to the N+1$^{th}$ reverse direction terminal REVn+1 of the main gate driver 130M. The second transistor Tb includes a gate electrode connected to a first signal line VGH, a first electrode connected to a second electrode, and a second electrode connected to a gate electrode of the first transistor Ta.

Once the first signal transmitted along the first signal line VGH is changed from logic low level L to logic high level H, the second transistor Tb is turned on. Once the second signal is transmitted through the first electrode of the second transistor Tb is changed from logic low level L to logic high level H, the first transistor Ta is turned on.

Once the first transistor Ta is turned on, the signal transmission circuit ST is activated. Once the signal transmission circuit ST is activated, the signal output from the N+1$^{th}$ reverse direction terminal REVn+1 of the main gate drier 130M is transferred to the N$^{th}$ reverse direction terminal REVn of the sub gate driver 130S.

The first signal transmitted along the first signal line VGH may use a gate high voltage supplied to the gate driver 130M and 130S, but aspects of the present disclosure are not limited thereto. In addition, the second signal transmitted along the second signal line VEND may use a gate high voltage supplied to the gate driver 130M and 130S, but aspects of the present disclosure are not limited thereto.

In the data driver driving case rather than an auto-probe AP driving case, the first and second signals are changed from logic high level H to logic low level L, as illustrated in FIG. 11. In particular, the second signal transmitted along the second signal line VEND has to be changed from logic high level H to logic low level L, but the first signal transmitted along the first signal line VGH is able to remain at logic high level H.

The N+1$^{th}$ forward direction terminal FWDn+1 of the M$^{th}$ reverse direction terminal REVm of the main gate driver 130M are connected to the second start signal line, and the N+1$^{th}$ reverse direction terminal REVn+1 of the main gate driver 130M is connected to the second electrode of the first transistor Ta. Accordingly, once the first transistor Ta is turned on, the N+1$^{th}$ reverse direction terminal REVn+1 of the main gate driver 130M may be transferred to the N$^{th}$ reverse direction terminal REVn of the sub gate driver 130S.

In the above-described aspect of the first embodiment of the present disclosure, a start signal VST2 is transmitted from an AP pad AP, and, once the signal transmission circuit ST is activated, the main gate driver 130M and the sub gate driver 130S are driven sequentially in the reverse direction REV.

[Embodiment 2]

Figure 14:
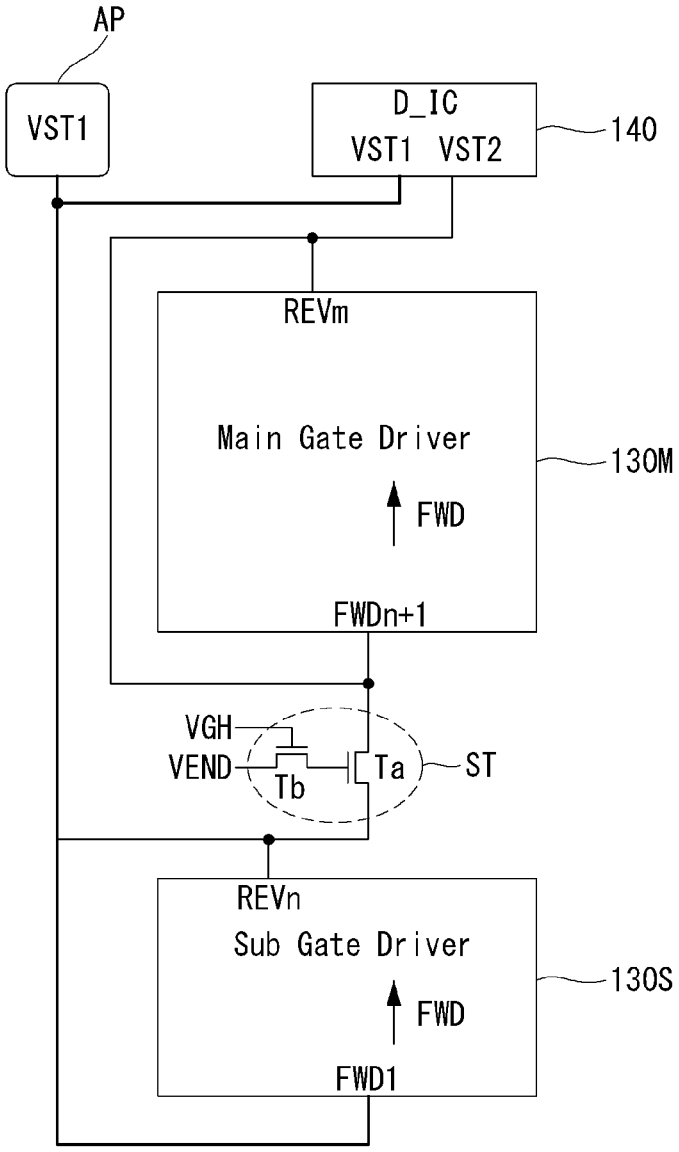
FIG. 14 is a diagram illustrating a part of a display panel according to a second embodiment of the present disclosure.
Figure 15:
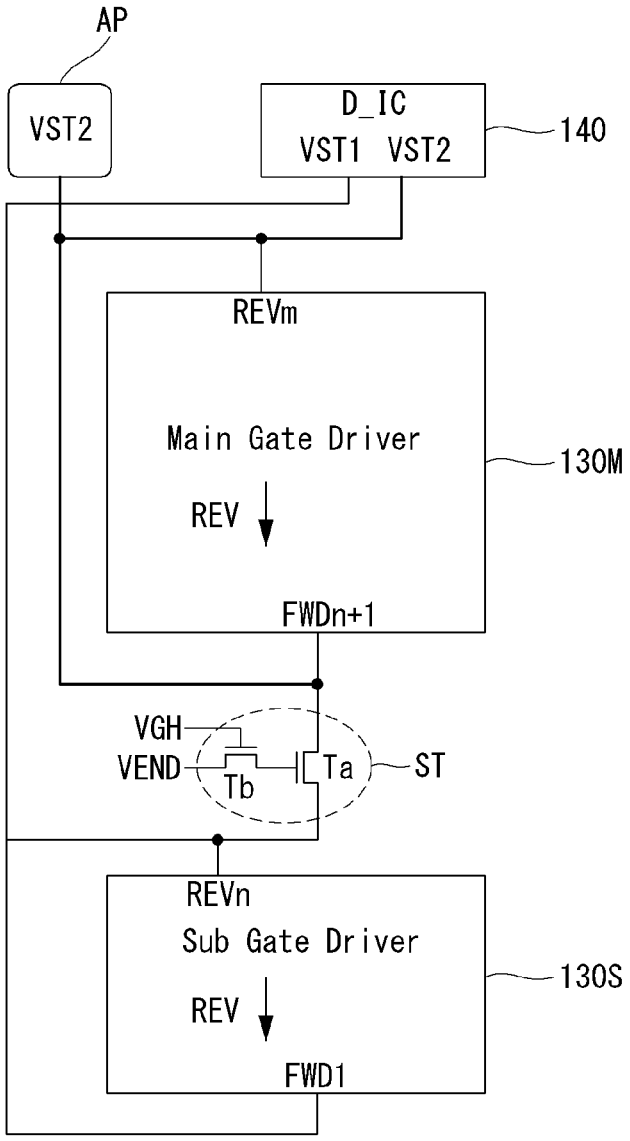
FIG. 15 is a diagram illustrating part of a display panel according to a modified example of the second embodiment of the present disclosure.
Figure 16:
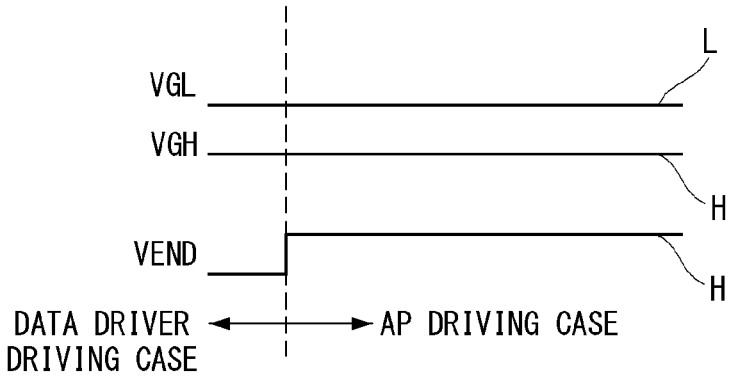
FIG. 16 is a waveform diagram illustrating a signal which is applied to a test transistor according to driving conditions.

FIG. 14 is a block diagram illustrating a part of a display panel according to a second embodiment of the present disclosure; FIG. 15 is a block diagram illustrating part of a display panel according to another aspect of the second embodiment of the present disclosure; FIG. 16 is a waveform diagram illustrating a signal which is applied to the signal transmission circuit ST according to driving conditions; and FIGS. 17 and 18 are block diagrams illustrating a flow of a start signal which is applied to a display panel according to the second embodiment of the present disclosure or the other aspect thereof.

In the second embodiment of the present disclosure, a main gate driver and a sub gate driver have a signal transmission circuit connected therebetween, and may be driven simultaneously in the forward direction or may be driven simultaneously in the reverse direction.

As the signal transmission circuit is connected between the main gate driver and the sub gate driver, only a single AP pad is used. The AP pad may transfer a first start signal or a second start signal along a start signal line.

Figure 17:
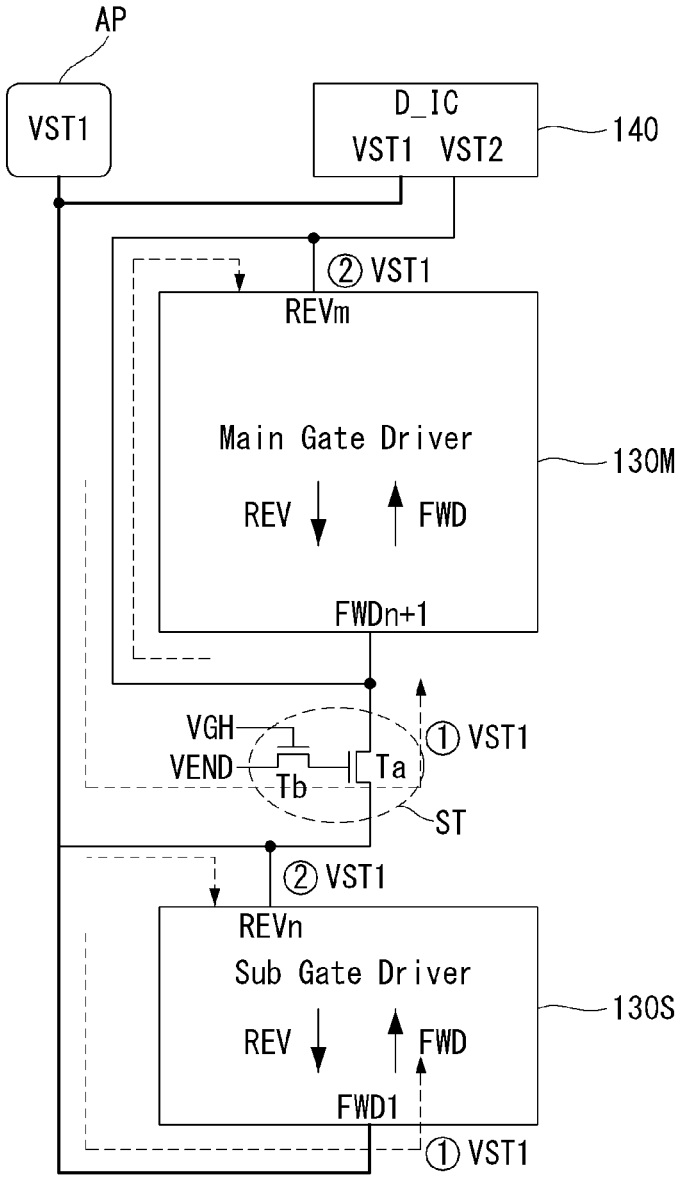
FIGS. 17 and 18 are diagrams illustrating a flow of a start signal which is applied to a display panel according to the second embodiment of the present disclosure or a modified example thereof.
Figure 18:
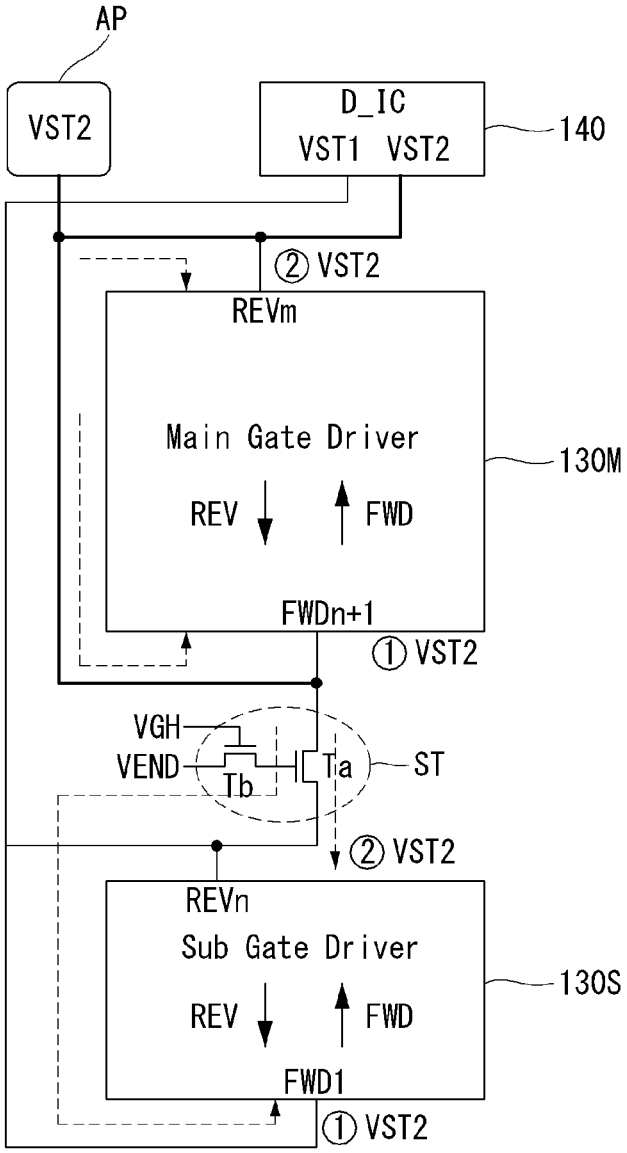

In the second embodiment shown in FIGS. 14, 16, and 17, a main gate driver 130M and a sub gate driver 130S operate based on a first start signal VST1 received through a first start signal line from an AP pad AP.

A signal transmission circuit ST is between the main gate driver 130M and the sub gate driver 130S. The signal transmission circuit ST transmits the first start signal VST1 to the N+1$^{th}$ forward direction terminal FWDn+1 of the main gate driver 130M.

The first transistor Ta includes a first electrode connected to the N$^{th}$ reverse direction terminal REVn of the sub gate driver 130S, and a second electrode connected to the N+1$^{th}$ forward direction terminal FWDn+1 of the main gate driver 130. The second transistor Tb includes a gate electrode connected to a first signal line VGH, a first electrode connected to a second signal line VEND, and a second electrode connected to a gate electrode of the first transistor Ta.

Once a first signal transmitted along the first signal line VGH is changed from logic low level L to logic high level H, the second transistor Tb is turned on. Once a second signal transmitted through the first electrode of the second transistor Tb is changed from logic low level L to logic high level H, the first transistor Ta is turned on.

Once the first transistor Ta is turned on, the signal transmission circuit ST is activated. Once the signal transmission circuit ST is activated, the first start signal VST1 is transferred to the N+1$^{th}$ forward direction terminal FWDn+1 of the main gate driver 130M.

The first signal transmitted along the first signal line VGH may use a gate high voltage supplied to a gate driver 130M and 130S, but aspects of the present disclosure are not limited thereto. The second signal transmitted along the second signal line VEND may use the gate high voltage supplied to the gate driver 130M and 130S, but aspects of the present disclosure are not limited. The gate high voltage is output from a power supply or a level shifter (not shown).

In data driver driving case rather than an auto-probe AP driving case, the first and second signals are changed from logic high level H to logic low level L. The second signal transmitted along the second signal line VEND has to be changed from logic high level H to logic low level L, but the first signal transmitted along the first signal line VGH is able to remain at logic high level H.

Referring to FIG. 14, the first forward direction terminal FWD1 and the $N^{th}$ reverse direction terminal REVn of the sub gate driver 130S are connected to the first start signal line from VST1. The first start signal line is connected to the first electrode of the first transistor Ta. The second electrode of the first transistor Ta is connected to the $N+1^{th}$ forward direction terminal FWDn+1 and the $M^{th}$ reverse direction terminal REVm of the main gate driver 130M.

The $N+1^{th}$ forward direction terminal FWDn+1 and the $M^{th}$ reverse direction terminal REVm of the main gate driver 130M are connected to the second start signal line. The second start signal line is also connected to the second electrode of the first transistor Ta. Accordingly, once the first transistor Ta is turned on, the main gate driver 130M may receive the first start signal VST1 along the first start signal line.

Referring to FIG. 17, when the signal transmission circuit ST is activated, the main gate driver 130M and the sub gate driver 130S are able to simultaneously receive the first start signal VST1 from the $N+1^{th}$ forward direction terminal FWDn+1 and the first forward direction terminal FWD1, respectively, so that the main gate driver 130M and the sub gate driver 130S are driven simultaneously in the forward direction FWD (see the dotted line indicating the flow of ①VST1). In addition, the main gate driver 130M and the sub gate driver 130S are able to receive the first start signal VST1 from the $M^{th}$ reverse direction terminal REVm and the $N^{th}$ reverse direction terminal REVn, so that the main gate driver 130M and the sub gate driver 130S are driven simultaneously in the reverse direction REV (see the dotted line indicating the flow of ②VST1). Therefore, the main gate driver 130M and the sub gate driver 130S may be driven simultaneously in two directions.

Thus, in a first aspect of the second embodiment of the present disclosure, a start signal VST1 is transferred from an AP pad AP, and, once the signal transmission circuit ST is activated, the sub gate driver 130S and the main gate driver 130M are driven simultaneously in the forward direction FWD and in the reverse direction REV.

In another aspect of the second embodiment, as shown in FIGS. 15, 16, and 18, a main gate driver 130M and a sub gate driver 130S operate based on a second start signal VST2 received through a second start signal line from an AP pad AP.

A signal transmission circuit ST is connected between the main gate driver 130M and the sub gate driver 130S. The signal transmission circuit ST transmits the second start signal VST2 to the $N^{th}$ reverse direction terminal REVn of the sub gate driver 130S.

The first transistor Ta includes a first electrode connected to the $N^{th}$ reverse direction terminal REVn of the sub gate driver 130S, and a second electrode connected to the $N+1^{th}$ reverse direction terminal REVn+1 of the main gate driver 130M. The second transistor Tb includes a gate electrode connected to a first signal line VGH, a first electrode connected to a second signal line VEND, and a second electrode connected to a gate electrode of the first transistor Ta.

Once a first signal transmitted along the first signal line VGH is changed from logic low level L to logic high level H, the second transistor Tb is turned on. Once a second signal transmitted through the first electrode of the second transistor Tb is changed from logic low level L to logic high level H, the first transistor Ta is turned on.

Once the first transistor is turned on, the signal transmission circuit ST is activated. Once the signal transmission signal ST is activated, the second start signal VST2 is transferred to the $N^{th}$ reverse direction terminal REVn of the sub gate driver 130S.

The first signal transmitted along the first signal line VGH may use a gate high voltage supplied to a gate driver 130M and 130S, but aspects of the present disclosure are not limited thereto. The second signal transmitted along the second signal line VEND may use the gate high voltage supplied to the gate driver 130M and 130S, but aspects of the present disclosure are not limited thereto. The gate high voltage is output from a power supply 180 or a level shifter (not shown).

In a data driver driving case rather than an auto-probe driving case, as shown in FIG. 16, the second signal is changed from logic high level H to logic low level L. In particular, the second signal transmitted along the second signal line VEND has to be changed from logic high level H to logic low level L, but the first signal transmitted along the first signal line VGH is able to remain at logic high level H.

Referring to FIG. 15, the first forward direction terminal FWD1 and the $N^{th}$ reverse direction terminal REVn of the sub gate driver 1305 are connected to the first electrode of the first transistor Ta. The second electrode of the first transistor Ta is connected to the first start signal line from VST1.

The $N+1^{th}$ forward direction terminal FWDn+1 and the $M^{th}$ reverse direction terminal REVm of the main gate driver 130M are connected to the second start signal line from VST2. The second start signal line is connected to the second electrode of the first transistor. Accordingly, once the first transistor Ta is turned on, the sub gate driver 130S is able to receive the second start signal transmitted along the second start signal line.

Referring to FIG. 18, the main gate driver 130M and the sub gate driver 130S are able to simultaneously receive the second start signal VST2 from the $N+1^{th}$ forward direction terminal FWDn+1 and the first forward direction terminal FWD1, respectively, so that the main gate driver 130M and the sub gate driver 130S are driven simultaneously in the forward direction FWD (see the dotted line indicating the flow of ①VST2). In addition, the main gate driver 130M and the sub gate driver 130S are able to simultaneously receive the second start signal VST2 from the $M^{th}$ reverse direction terminal REVm and the $N^{th}$ reverse direction terminal REVn, respectively, so that the main gate driver 130M and the sub gate driver 1305 are driven in the reverse direction REV (see the dotted line indicating the flow of ②VST2). Therefore, the main gate driver 130M and the sub gate driver 130S may be driven simultaneously in two directions.

Considering the second embodiment and the modified example thereof, the main gate driver 130M and the sub gate driver 130S use the first and second start signals VST1 and VST2 having the same waveform in an auto-probe AP driving case. However, in a data driver driving case, the first start signal VST1 and the second start signal VST2 have to be separate temporally, using the signal transmission circuit ST.

In the above-described modified example of the second embodiment, a start signal VST2 is transferred from the AP pad AP, and, once the signal transmission circuit ST is activated, the main gate driver 130M and the sub gate driver 130S are driven simultaneously in the forward direction FWD and in the reverse direction REV.

[Embodiment 3]

Figure 19:
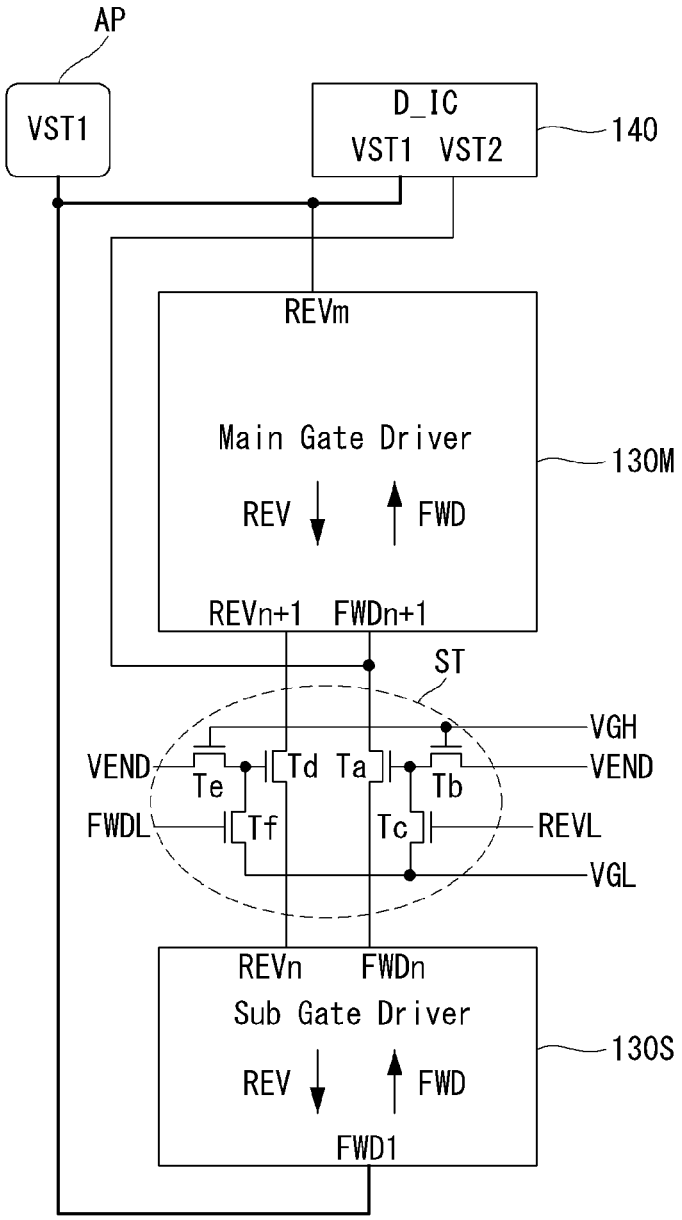
FIG. 19 is a diagram illustrating part of a display panel according to a third embodiment of the present disclosure.
Figure 20:
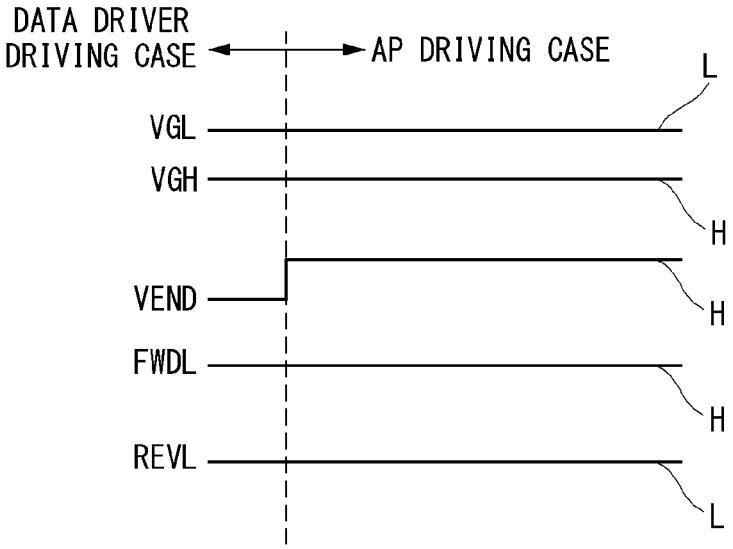
FIGS. 20 and 21 are waveform diagrams illustrating a signal applied to a test transistor according to driving conditions.
Figure 21:
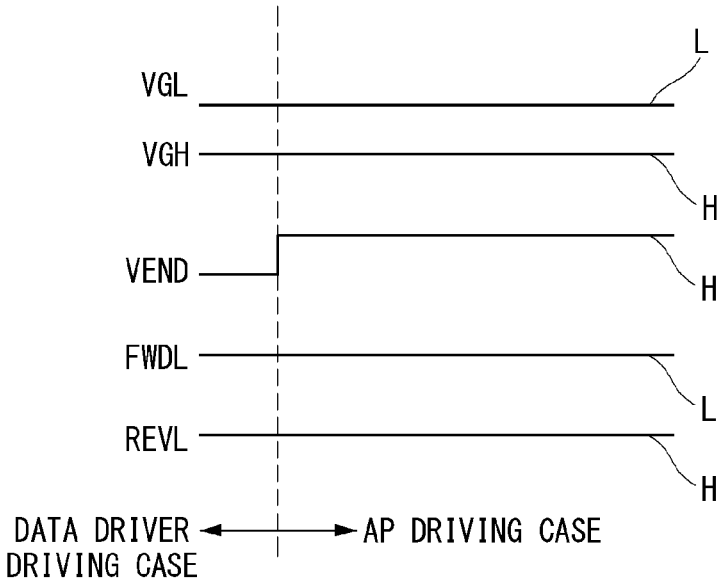
Figure 22:
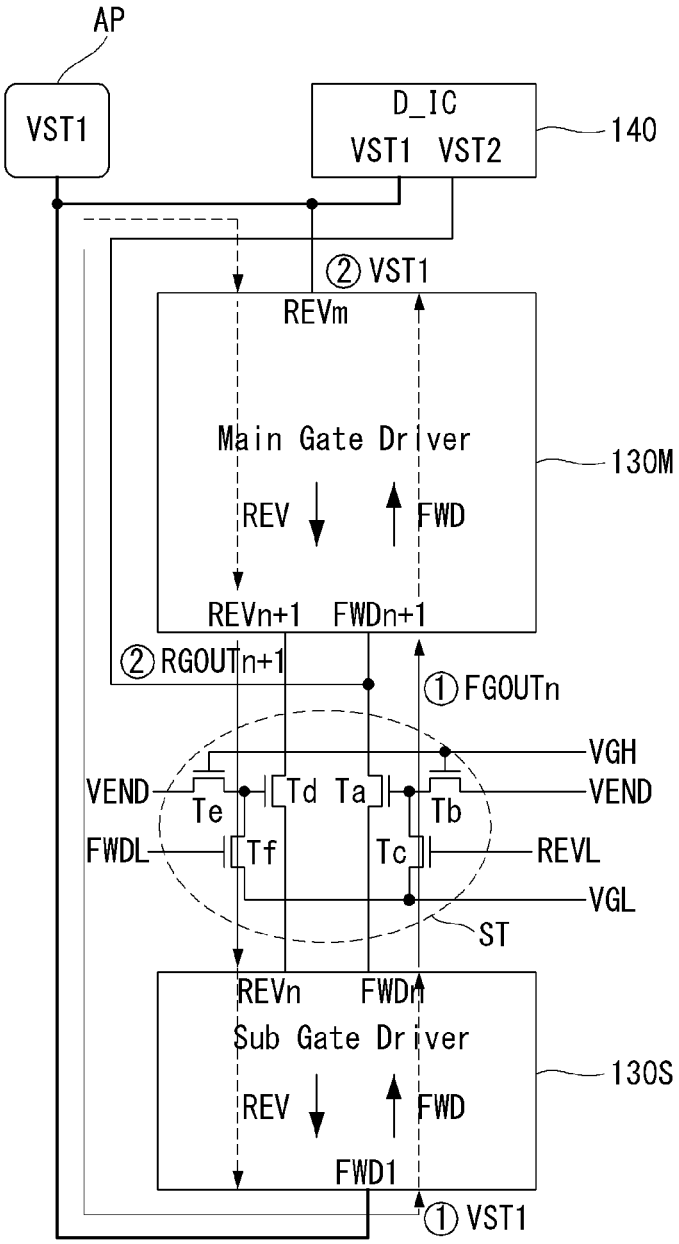
FIG. 22 is a diagram illustrating the flow of a start signal applied to a display panel according to the third embodiment of the present disclosure.

FIG. 19 is a block diagram illustrating part of a display panel according to a third embodiment of the present disclosure; FIGS. 20 and 21 are waveform diagrams illustrating a signal applied to a signal transmission circuit ST2 according to driving conditions; and FIG. 22 is a block diagram illustrating the flow of a start signal applied to a display panel according to the third embodiment of the present disclosure.

In the third embodiment of the present disclosure, a main gate driver and a sub gate driver have a signal transmission circuit connected therebetween and may be able to be driven sequentially in a forward direction or in a reverse direction.

As the signal transmission circuit is between the main gate driver and the sub gate driver, only a single AP pad is used. The AP pad is able to transmit either a first start signal or a second start signal through a start signal line. In this example, the AP pad transmits the first start signal.

In the third embodiment as shown in FIGS. 19 to 22, a main gate driver 130M and a sub gate driver 130S operate based on a first start signal VST1 received through the first start signal line from the AP pad.

A signal transmission circuit ST2 is connected between a main gate driver 130M and a sub gate driver 130S. The signal transmission circuit ST2 transmits a signal output from the $N^{th}$ forward direction terminal FWDn of the sub gate driver 130S to the $N+1^{th}$ forward direction terminal FWDn+1 of the main gate driver 130M. In addition, the signal transmission circuit ST2 transmits a signal output from the $N+1^{th}$ forward direction terminal FWDn+1 of the main gate driver 130M to the $N^{th}$ forward direction terminal FWDn of the sub gate driver 130S.

The signal transmission circuit ST2 transmits a signal output from the $N^{th}$ reverse direction terminal REVn of the sub gate driver 1305 to the $N+1^{th}$ reverse direction terminal REVn+1 of the main gate driver 130M. In addition, the signal transmission circuit ST2 transmits a signal output from the $N+1^{th}$ reverse direction terminal REVn+1of the main gate driver 130M to the $N^{th}$ reverse direction terminal REVn of the sub gate driver 1305.

The signal transmission circuit ST2 includes a first transistor Ta to a sixth transistor Tf.

The first transistor Ta includes a first electrode connected to the $N^{th}$ forward direction terminal FWDn of the sub gate driver 130S, and a second electrode connected to the $N+1^{th}$ forward direction terminal FWDn+1 of the main gate driver 130M. The second transistor Tb includes a gate electrode connected to a first signal line VGH, a first electrode connected to the second signal line VEND, and a second electrode connected to a gate electrode of the first transistor Ta. The third transistor Tc includes a gate electrode connected to a fourth signal line REVL, a first electrode connected to a third signal line VGL, and a second electrode connected to the gate electrode of the first transistor Ta. The first transistor Ta to the third transistor Tc constitute a first signal transmission circuit which controls a sequential driving operation of the forward direction FWD.

Referring to FIG. 20, once a first signal transmitted along the first signal line VGH is supplied, the second transistor Tb is turned on. Once a second signal VEND transmitted through the first electrode of the second transistor Tb is changed from logic low level L to logic high level H, the first transistor Ta is turned on. At this point, a fourth signal transmitted along the fourth signal line REVL remains at logic low level L, and a fifth signal transmitted along the fifth signal line FWDL remains at logic high level H.

Once the first portion of the signal transmission circuit ST2 (Ta to Tc) is activated, a signal output from the $N^{th}$ forward direction terminal FWDn of the sub gate driver 1305 is transmitted to the $N+1^{th}$ forward direction terminal FWDn+1 of the main gate driver 130M. In such an auto-probe AP driving condition, the sub gate driver 1305 and the main gate driver 130M are driven sequentially in the forward directions FWD.

The fourth transistor Td includes a first electrode connected to the $N^{th}$ reverse direction terminal REVn of the sub gate driver 130S, and a second electrode connected to the $N+1^{th}$ reverse direction terminal REVn+1 of the main gate driver 130M. The fifth transistor Te includes a gate electrode connected to the first signal line VGH, a first electrode connected to the second signal line VEND, and a second electrode connected to a gate electrode of the fourth transistor Td. The sixth transistor Tf includes a gate electrode connected to a fifth signal line FWDL, a first electrode connected to the third signal line VGL, and a second electrode connected to the gate electrode of the fourth transistor Td. The fourth transistor Td to the sixth transistor Tf constitute a second portion of the signal transmission circuit ST2 which controls a sequential driving operation of the reverse direction REV.

Referring to FIG. 21, once a first signal transmitted along the first signal line VGH is changed from logic low level L to logic high level H, the fifth transistor Te is turned on. Once a second signal VEND transmitted through the first electrode of the fifth transistor Te is changed from logic low level L to logic high level H, the fourth transistor Td is turned on. At this point, the fourth signal transmitted along the fourth signal line REVL remains at logic high level H, and the fifth signal transmitted along the fifth signal line FWDL remains at logic low level L.

Once the second portion of the signal transmission circuit STS2 (Td to Tf) is activated, a signal output from the $N+1^{th}$ reverse direction terminal REVn+1 of the main gate driver 130M is transmitted to the $N^{th}$ reverse direction terminal REVn of the sub gate driver 1305. In such an auto-probe AP driving condition, the main gate driver 130M and the sub gate driver 130S are driven sequentially in the reverse direction REV.

The first signal transmitted along the first signal line VGH may use a gate high voltage supplied to a gate driver 130M and 130S, but aspects of the present disclosure are not limited thereto. The second signal transmitted along the second signal line VEND may use the gate high voltage supplied to the gate driver 130M and 130S, but aspects of the present disclosure are not limited thereto. The gate high voltage is output from a power supplier and a level shifter.

In data driver driving mode rather than an auto-probe AP driving mode, the second signal is changed from logic high level H to logic low level L. In particular, the second signal transmitted along the second signal line VEND has to be changed from logic high level H to logic low level L, but the first signal transmitted along the first signal line VGH is able to remain at logic high level H.

The fourth signal transmitted along the fourth signal line REVL and the fifth signal transmitted along the fifth signal line FWDL are maintained at respective levels reversed to each other. The fourth and fifth signal may be output from the power supply or the level shifter (not shown), but aspects of the present disclosure are not limited thereto.

Referring to FIG. 19, the first forward direction terminal FWD1 of the sub gate driver 130S and the $M^{th}$ reverse direction terminal REVm of the main gate driver 130M are connected to the first start signal line. The second start signal line is connected to the $N+1^{th}$ forward direction terminal FWDn+1 of the main gate driver 130M.

Referring to FIG. 22, once the first portion of the signal transmission circuit ST2 (Ta to Tc) is activated, the sub gate driver 130S performs a sequential driving operation based on the first start signal VST1 transmitted from the first forward direction terminal FWD1, and then outputs the $N^{th}$ forward direction signal FGOUTn. The main gate driver 130M performs a sequential driving operations based on the $N^{th}$ forward direction signal FGOUTn transmitted to the $N+1^{th}$ forward direction terminal FWDn+1. That is, the sub gate driver 130S and the main gate driver 130M are driven sequentially in the forward direction FWD (see the dotted line indicating the flow of ①VST1).

Once the second signal portion of the transmission circuit ST2 (Td to Tf) is activated, the main gate driver 130M performs a sequential driving operation based on the first start signal VST1 transmitted to the $M^{th}$ reverse direction terminal REFVm, and then outputs the $N+1^{th}$ reverse direction signal RGOUTn+1. The sub gate driver 1305 performs a sequential driving operation based on the $N+1^{th}$ reverse direction signal RGOUTn+1 transmitted to the $N^{th}$ reverse direction terminal REVn. That is, the main gate driver 130M and the sub gate driver 130S are driven sequentially in the reverse direction REV (see the dotted line indicating the flow of ②VST1). Therefore, the main gate driver 130M and the sub gate driver 130S may be driven sequentially in two directions.

In the third embodiment of the present disclosure, a start signal VST1 is transmitted from the AP pad AP, and, once any one of the first portion of the signal transmission circuit ST2 (Ta to Tc) and the second portion of the signal transmission circuit ST2 (Td to Tf) is activated, the sub gate driver 130S and the main gate driver 130M perform a sequential driving operation of the forward direction FWD or the reverse direction REV.

According to the above embodiments of the present disclosure, input and output terminals of the main gate driver 130M and the sub gate driver 130S are connected (to transmit a signal in the first direction (forward) or in the second direction (reverse)), or a signal transmission circuit is connected between the input and output terminals to transmit a start signal, so that auto-probe test may be conducted with only a single AP pad.

As such, the present disclosure is able to embody a display panel for which an auto-probe test can be conducted with a single AP pad and a signal transmission circuit that is connected between two electrically separate gate drivers to transmit a signal, so that it may solve a problem led by the limitation to a non-active display or bezel region or an increase in size of the bezel area. In addition, the present disclosure is able to operate two electrically separate gate drivers in various ways according to a configuration of the signal transmission circuit, and it may be used in various fields and use (utilize) an existing inspecting device.

What is claimed is:

1. A display device, comprising:

a display panel including a first non-display area, a second non-display area, a main active area, and a sub active area, wherein the main active area and the sub active area each includes a matrix of sub-pixels;

a data driver in the first non-display area to provide image data to the matrices of sub-pixels;

a main gate driver in the second non-display area to provide a corresponding gate signal to each sub-pixel in the main active area;

a sub gate driver in the second non-display area to provide a corresponding gate signal to each sub-pixel in the sub active area;

an auto-probe test pad in the non-display area for transmitting a first start signal received from an auto-probe signal generating device to one of the main gate driver and the sub gate driver while testing the display panel; and a signal transmission circuit to transmit signals between the main gate driver and the sub gate driver, wherein the signal transmission circuit is activated in response to a signal which is transmitted from the outside, so that the main gate driver and the sub gate driver are sequentially driven in a forward direction, sequentially driven in a reverse direction, simultaneously driven in two directions, or sequentially driven in two directions.

2. The display device of claim 1, wherein the first start signal is transmitted through the data driver while not testing.

3. The display device of claim 1, wherein the main gate driver and the sub gate driver are driven sequentially in a same direction.

4. The display device of claim 1, wherein the signal transmission circuit includes a first transistor and a second transistor.

5. The display device of claim 4, wherein the first transistor is connected between a direction terminal on the sub gate driver and a direction terminal on the main gate driver to set a driving direction of the main gate driver and the sub gate driver.

6. The display device of claim 4, wherein the second transistor is connected between a gate of the first transistor and a second signal line and controlled by a first signal line.

7. The display device of claim 1, further comprising:

a second start signal, wherein the first start signal determines a driving direction of the sub gate driver and the second start signal determines a driving direction of the main gate driver, wherein the sub gate driver and the main gate driver are driven sequentially.

8. The display device of claim 1, further comprising:

a second start signal, wherein the first start signal determines a driving direction of the sub gate driver and the second start signal determines a driving direction of the main gate driver, wherein the sub gate driver and the main gate driver are driven simultaneously.

9. The display device of claim 1, wherein the first start signal determines a simultaneous driving of the sub gate driver and the main gate driver in a direction.

10. The display device of claim 1, wherein the signal transmission circuit connected between the main gate driver and the sub gate driver includes a first portion and a second portion, wherein the first portion and the second portion each include three transistors.

11. A display device comprising:

a lower substrate;

a display area comprising a main display area and a sub display area, each of which consists of sub-pixels disposed on the lower substrate;

a data driver configured to transmit a data signal to the main display area and the sub display area;

a gate driver comprising a main gate driver transmitting a gate signal to the main display area, and a sub gate driver transmitting a gate signal to the sub display area; and a signal transmission circuit configured to transmit signals, which are output from input and output terminals of the main gate driver and the sub gate driver, in a first direction or in a second direction, wherein the signal transmission circuit is activated in response to a signal which is transmitted from the outside, so that the main gate driver and the sub gate driver are sequentially driven in a forward direction, sequentially driven in a reverse direction, simultaneously driven in two directions, or sequentially driven in two directions.

12. The display device of claim 11, wherein the lower substrate comprises an auto-probe test pad disposed on a non-display area, and either or both of the main gate driver and the sub gate driver operate based on a start signal transmitted along a start signal line connected to the auto signal probe pad.

13. The display device of claim 12, wherein the signal transmission circuit connects input and output terminals of the main gate driver and the sub gate driver or transmits a start signal to the input and output terminals of the main gate driver and the sub gate driver.

14. The display device of claim 11, wherein the signal transmission circuit comprises:

a first transistor having a first electrode connected to a Nth terminal of the sub gate driver, and a second electrode connected to a N+1th terminal of the main gate driver; and a second transistor comprising a gate electrode connected to a first signal line; a first electrode connected to a second signal line, and a second electrode connected to a gate electrode of the first transistor.

15. The display device of claim 14, wherein the signal transmission circuit is activated when the first transistor is turned on.

16. The display device of claim 14, wherein the second electrode of the first transistor is connected to a start signal line which is connected to an auto-probe test pad.

17. The display device of claim 11, wherein the signal transmission circuit comprises:

a first signal transmission circuit configured to sequentially drive the main gate driver and the sub gate driver in a forward direction; and a second signal transmission circuit configured to sequentially drive the main gate driver and the sub gate driver in a reverse direction.

18. The display device of claim 17, wherein the first signal transmission circuit comprises:

a first transistor having a first electrode connected to a Nth forward direction terminal of the sub gate driver, and a second electrode connected to a N+1th forward direction terminal of the main gate driver;

a second transistor having a gate electrode connected to a first signal line, a first electrode connected to a second signal line, and a second electrode connected to a gate electrode of the first transistor; and a third transistor having a gate electrode connected to a fourth signal line, a first electrode connected to a third signal line, and a second electrode connected to the gate electrode of the first transistor, wherein the second signal transmission circuit comprises:

a fourth transistor having a first electrode connected to a Nth reverse direction terminal of the sub gate driver, and a second electrode connected to a N+1th reverse direction terminal of the main gate driver;

a fifth transistor having a gate electrode connected to the first signal line, a first electrode connected to the second signal line, and a second electrode connected to a gate electrode of the fourth transistor; and a sixth transistor having a gate electrode connected to the fifth signal line, a first electrode connected to the third signal line, and a second electrode connected to the gate electrode of the fourth transistor.

19. The display device of claim 18, wherein a first forward direction terminal of the sub gate driver and a Mth reverse direction terminal of the main gate driver are connected to a start signal line which is connected to an auto-probe test pad.

* * * * *